US005655553A

United States Patent [19]

Giese et al.

[11] Patent Number: 5,655,553

[45] Date of Patent: Aug. 12, 1997

[54] COSMETICS COMPACT HAVING REMOVABLE MAKEUP PANS

[75] Inventors: Timothy L. Giese, Wauwatosa; Keith S. Everson, Hartland, both of Wis.; Timothy Maddy, Dallas, Tex.

[73] Assignee: Mary Kay Inc., Dallas, Tex.

[21] Appl. No.: 369,406

[22] Filed: Jan. 5, 1995

[51] Int. Cl.[6] ..... A45D 33/00

[52] U.S. Cl. ..... 132/303; 132/315; 132/314; 132/293; 132/295; 206/581; 221/79

[58] Field of Search ..... 132/303, 315, 132/314, 293, 295; 206/581, 823; 221/208, 79, 80

[56] References Cited

U.S. PATENT DOCUMENTS

| | | | |
|---|---|---|---|
| 1,626,613 | 5/1927 | Kendall . | |
| 1,642,611 | 9/1927 | Kendall . | |
| 1,643,944 | 10/1927 | Cook . | |
| 1,767,567 | 6/1930 | Weil . | |
| 1,851,462 | 3/1932 | Steller . | |
| 1,892,736 | 1/1933 | Root . | |
| 1,902,681 | 3/1933 | Tuttle et al. . | |
| 2,054,004 | 9/1936 | Sandberg | 132/293 |
| 2,150,863 | 3/1939 | Morin | 221/80 |
| 2,215,480 | 9/1940 | Sampson . | |
| 2,233,379 | 2/1941 | Cope | 221/80 |
| 2,370,928 | 3/1945 | Baldanza . | |
| 2,628,625 | 2/1953 | Pike . | |
| 2,646,786 | 7/1953 | Robertson | 221/79 |
| 2,669,380 | 2/1954 | Grenier . | |
| 2,752,724 | 7/1956 | Carpenter . | |
| 2,865,497 | 12/1958 | Schwartz . | |
| 3,183,101 | 5/1965 | Peters . | |
| 3,403,714 | 10/1968 | Hulm . | |
| 3,604,556 | 9/1971 | Schwartz . | |
| 4,863,034 | 9/1989 | Contreras, Sr. . | |
| 4,889,254 | 12/1989 | Vola . | |
| 5,092,354 | 3/1992 | Pacelli, Jr. | 206/823 |

FOREIGN PATENT DOCUMENTS

| | | |
|---|---|---|
| 0 685 182 A1 | 12/1995 | European Pat. Off. . |
| 590478 | 6/1925 | France . |
| 2 585 935 | 2/1987 | France . |
| 2739137 | 3/1979 | Germany . |
| 320145 | 4/1957 | Switzerland . |
| 136783 | 12/1919 | United Kingdom . |
| 835485 | 5/1960 | United Kingdom . |

*Primary Examiner*—Gene Mancene
*Assistant Examiner*—Pedro Philogene
*Attorney, Agent, or Firm*—Finnegan, Henderson, Farabow, Garrett & Dunner, L.L.P.

[57] ABSTRACT

A container such as a compact for removably holding a plurality of removable articles such as makeup pans is disclosed. The compact has a bottom portion including a platform equipped for removably holding the articles, a bottom wall having openings therein each of which is aligned with a respective article, and an article ejector disposed between the platform and the bottom wall. The ejector has a connecting member which communicates with buttons and locator members such as upstanding bosses, for aligning the respective buttons each with an underlying bottom wall opening and a removable article. When pressure is applied through an opening onto a button, the button moves and ejects the article from its holder means. The compact has a retaining receptacle which can be an inverted U-shaped channel cooperative with the locator members for retaining them and thereby retaining the ejector in its aligned operative position. The ejector can be a gasket having a plurality of buttons, a connecting member in communication with the buttons, and one or more locator members which extend from the connecting member.

30 Claims, 8 Drawing Sheets

COSMETICS COMPACT HAVING REMOVABLE MAKEUP PANS

BACKGROUND

In the cosmetics industry, various containers such as compacts, herein also understood to include vanity cases, have been used to house removable articles. These removable articles include such things as a lipstick case or an eyebrow pencil or removable receptacles, usually pans containing such makeup items as eyeshadow and paste rouge.

These articles have been removable by various means, but the means for removing them have been complicated, have required a pointed object to be inserted through the compact bottom wall, or have been otherwise unsatisfactory. There is a need for a compact having a plurality of removable articles, such as makeup pans, which can be selectively easily removed from the compact, for example, when separate use, replacement or refilling of the same is desired. There has been a need for such a compact which not only provides means for selectively and easily removing one or more of the articles from the compact, but which also is economical, and easy to manufacture, assemble and use.

It is therefore an object of this invention to provide a container or compact which meets one or more of the above or other needs. Accordingly, an object of this invention is to provide a cosmetics compact which includes means for selectively and easily ejecting one or more of a plurality of articles, e.g. makeup pans, from the compact.

Another object is to provide a compact such as referred to above which is easy to manufacture, assemble and use.

Another object is to provide a compact having means for removably holding cosmetic articles in the compact, and means for selectively ejecting one or more of the articles from the holding means.

Yet another object is to provide ejection means or an injector piece for a compact which is easy and economical to manufacture, assemble with the compact, and use.

These and other objects, features and advantages of the invention will be apparent from the description of the invention which follows.

SUMMARY OF THE INVENTION

The invention is in a container such as a compact which has a plurality of removable articles such as makeup pans. The container comprises a top portion, a bottom portion having means for holding a structure and a bottom wall with a plurality of openings therein. A structure such as a platform adapted to be held by the holding means and having means for removably holding a plurality of the articles therein is included so that a portion of each article is associated with a bottom wall opening. An article ejector is disposed between the bottom wall and platform and comprised of a plurality of ejector buttons, a connecting member. The connecting member preferably has one or more flexible portions and connects the buttons to each other. The connecting member also preferably includes a main body and a plurality of arms, and has means for retaining the ejector in an aligned operative position between the structure and the bottom wall.

The retaining means includes cooperating first and second retaining means provided by at least two of the container elements selected from the structure, the article ejector and the bottom wall. The retaining means is adapted such that each respective button is aligned with a respective bottom wall opening and an associated overlying article when the articles are held by their holding means. The retaining means is operative such that when pressure is applied upwardly through a bottom wall opening onto a button, the button moves and applies upward pressure to an overlying article and ejects it from its holding means.

Preferably, the structure includes a first retaining means comprised of one or more receptacles, and the ejector includes a second retaining means comprised of locator means which can be or include one or more locator members such as one or more bosses which extend from the ejector, and are retained by one or more receptacles.

Also in accordance with a preferred embodiment the connecting member is disposed mostly in the horizontal plane and the one or more locator members or bosses extend away from the plane of and upwardly from the connecting member and are retained by the one or more receptacles. One or more of the receptacles can be an inverted U-shaped channel defined by depending side walls which retain the bosses and/or a portion of the connecting member. One or more locator members can extend downwardly from the connecting member which preferably has a main body and one or more arms, each of which extends from the main body and communicates with a button. The one or more receptacles can include one or more passageways each of which retains an arm. The bottom wall can include first retaining means comprised of one or more receptacles and the ejector can include a second retaining means comprised of one or more members which extend from the ejector and are retained by the one or more receptacles. Preferably, each bottom wall opening is defined by a rim, and each button has a depending sidewall which is disposed within the opening with respect to which the button is aligned. The ejector buttons preferably also have a stop surface which is adjacent and extends outwardly beyond the lower side wall and prevents the buttons from protruding through the bottom wall opening. An upwardly concave bottom surface and an upwardly extending tab is adjacent the top surface for contacting and ejecting an overlying article.

The invention is also in an article ejector, sometimes referred to herein as an ejector piece, which can simply comprise a plurality of ejector buttons, a connecting member which has one or more flexible portions and which connects the buttons to each other, and one or more bosses which extend upwardly from the connecting member. Alternatively, it can be as described previously above, for ejecting articles such as makeup pans from a container or compact. The ejector has locator means which can be one or more locator members or bosses on the connecting member for locating the connecting member relative to the container such that the buttons sit in the openings and are oriented to apply pressure to and eject the articles when the ejector is housed within the container.

The container, preferably the ejector, is adapted to permit the buttons to move upon the application of finger pressure and to return to their normal position upon release of such pressure. An alternative ejector embodiment comprises a flexible gasket which can include a panel section with a side edge having buttons connected to the panel section adjacent its side edge. The gasket can include two juxtaposed panel sections connected to each other by a bridge member, wherein the buttons are arranged in two sets, one set being connected to the side edge of one panel section and the other set being connected to the side edge of the other panel section.

BRIEF DESCRIPTION OF THE DRAWINGS

One way of carrying out the invention is described in detail below with reference to drawings which illustrate only one specific embodiment of the invention and in which.

DETAILED DESCRIPTION OF THE PREFERRED EMBODIMENTS

Figure 1:
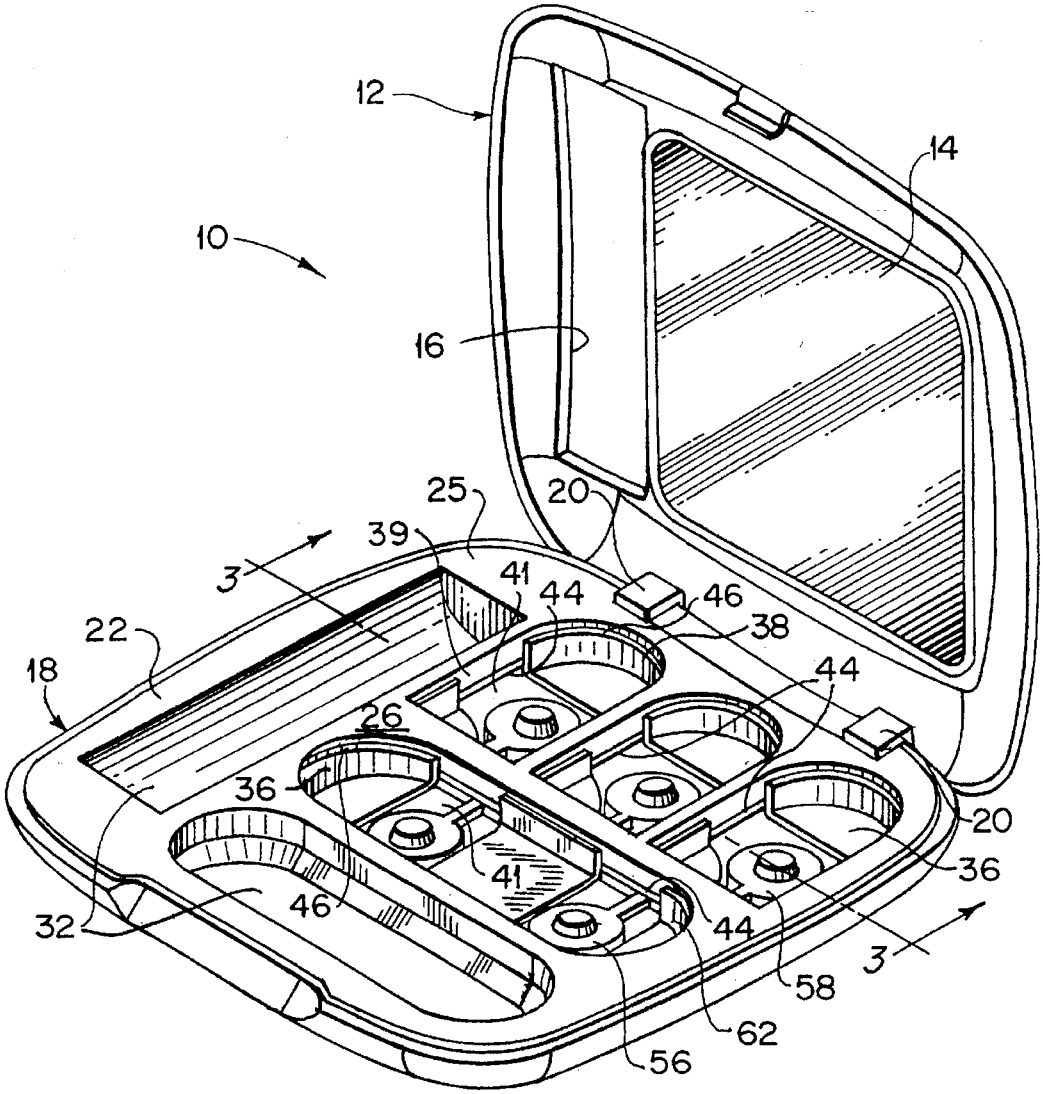
FIG. 1 is a perspective view of a preferred embodiment of the container or compact of this invention.
Figure 2:
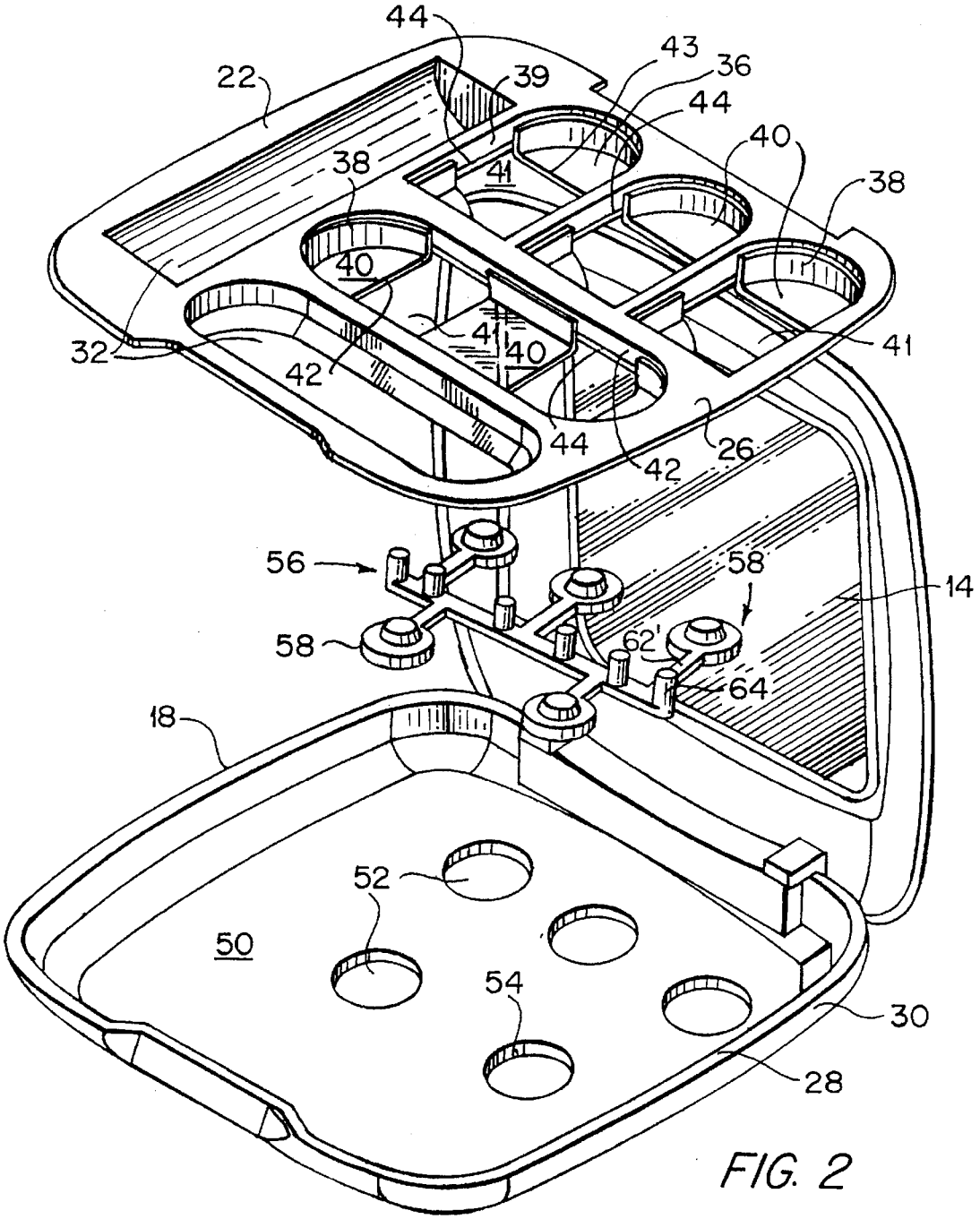
FIG. 2 is an exploded view of the components of the compact shown in FIG. 1.
Figure 3:
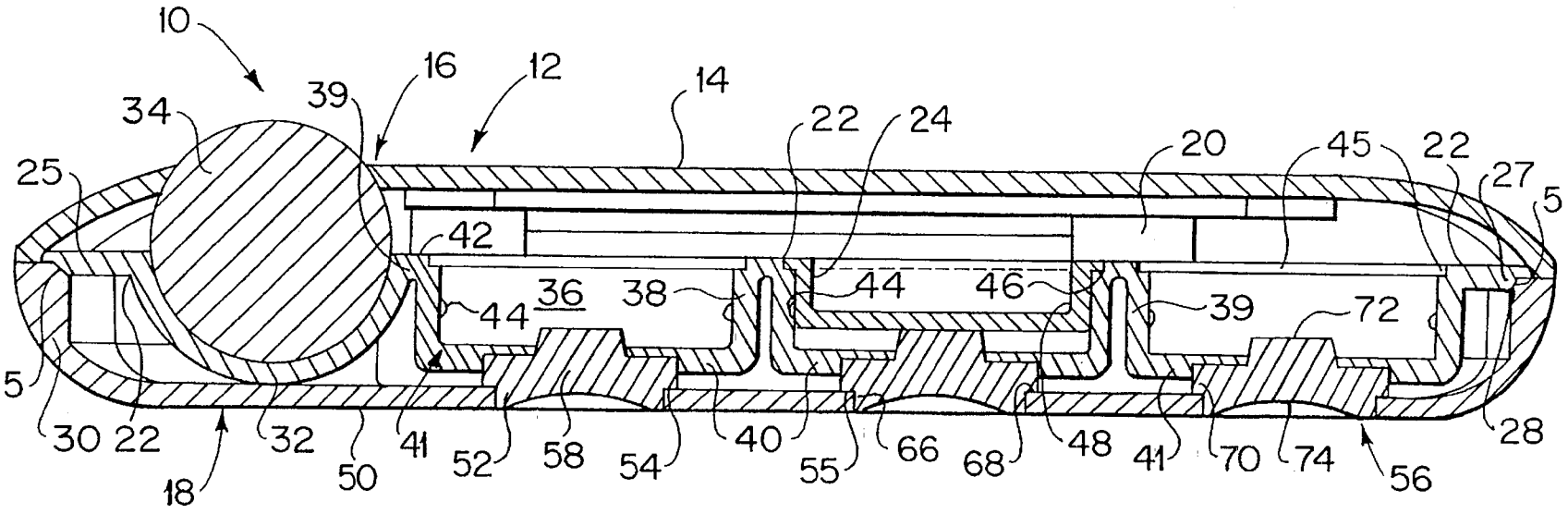
FIG. 3 is a vertical sectional view as would be seen along line 3—3 of FIG. 1.

This invention is in a container which has means for removably holding articles and means including an ejector for ejecting the articles from the holding means. More particularly, FIGS. 1–3 show a preferred embodiment of such a container, in the form of a compact, generally designated 10, comprised of a top portion or cover 12 having a mirror 14 attached thereto and a cutout area 16 therein, the cover being movably connected to a bottom portion 18 by suitable means, here shown as hinges 20 such that the cover can open and close the bottom portion.

The bottom portion has suitable means for holding or securing a platform 22, or one or more other suitable means, for holding a plurality of removable cosmetic articles such as makeup pans 24 (FIG. 3) in the compact. In this embodiment, the means for securing the platform includes a platform undersurface portion 27 adjacent its outer edge which is adapted to engage and be adhered by a continuous band or spots 5 of adhesive to an upper surface portion 28 of bottom portion side wall 30.

Platform 22 has a top panel 25 having closed bottomed pockets 32 for receiving cosmetics articles such as a lipstick case 34, and a plurality of recessed areas, here, wells 36. Wells 36 are defined by a rim and have side wall portions 38 (FIG. 10), depending from the platform and communicate with bottom wall portions 40, each well having an aperture 41 therein defined by an edge 42, adjacent to and including a lower or bottom portion of the well. Some of the apertures include a passageway 43 defined by edges 43'. Sidewall portions 38 have means for removably holding articles in wells 36, here shown as including a shortened sidewall portion 39 having elongated horizontal beads 44 extending outwardly therefrom into the well, and a step 46 at the juncture of platform top wall 25 and one or more portions of side wall portions 38.

Makeup pans 24 have a peripheral flange 45 extending from their sidewall which rests on a platform step 46, and a continuous groove or one (or more) individual indent 48 which extends into the sidewall and frictionally engages beads 44 to removably hold the pans in the platform.

Figure 4:
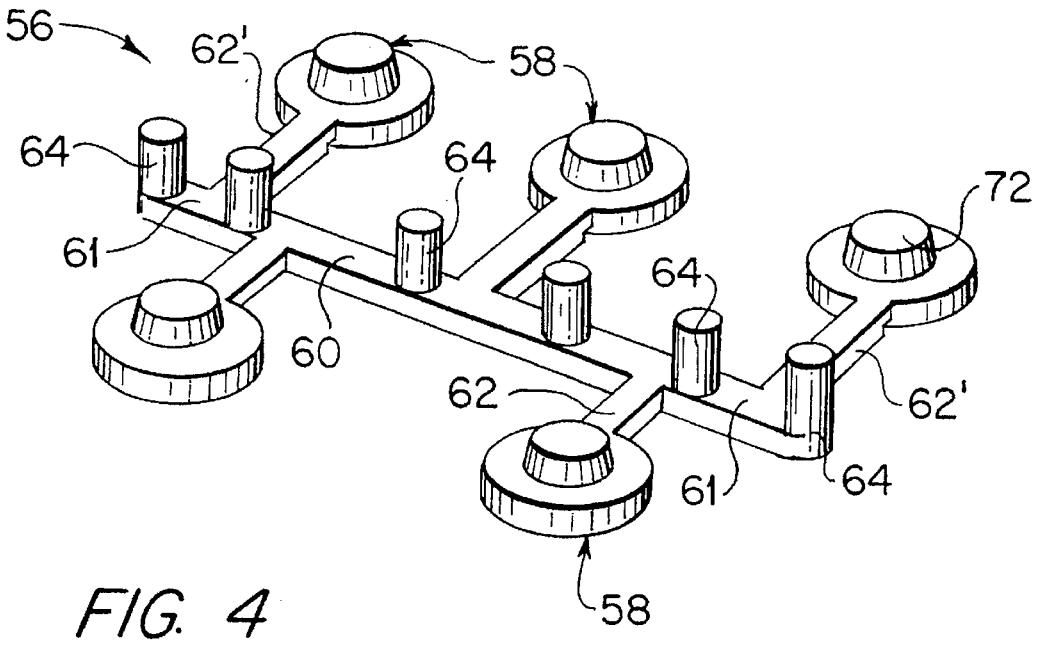
FIG. 4 is an enlarged perspective view of the ejector shown in FIG. 2.

Compact bottom portion 18 has a bottom wall 50 which has a plurality of openings 52 therein, each defined by a raised rim 54 and an edge 55. Between platform 22 and a bottom wall 50 there is disposed an article ejector, sometimes referred to herein as an ejector piece or an ejector, generally designated 56 (shown by itself in perspective in FIG. 4), comprised of a plurality of buttons 58, a connecting member, here shown as a runner 60 having a main body 61 and arms, here short arms 62 and long arms 62'.

The arms connect the buttons to each other, and retaining means. The retaining means as will be explained, can be second retaining means such as locator means, here shown as a plurality of locator members preferably in the form of bosses 64 which are connected to, and preferably integral with and extending upwardly from runner 60. This retains the ejector in an operative position, wherein each respective button 58 is aligned with a respective bottom wall opening 52, and an overlying pan 24.

FIGS. 3 through 9 show that the ejector connecting member or runner 60 has a main body 61 and arms 62, 62' which extend perpendicularly outward from the main body, on the same or substantially the same plane as the main body, each arm communicating with a button 58. Each button preferably has a lower, depending sidewall 66 and a stop surface, here shown as the undersurface 68 of peripheral flange 70. This surface is adjacent and extends outwardly beyond the sidewall for abutting the bottom wall raised rim 54 and thereby preventing the button from protruding beyond the bottom surface of bottom wall 50.

Each button preferably also includes an upwardly concave bottom surface 74 which facilitates fingertip placement and the application of pressure centrally within the button bottom surface, and a tab 72 on the top of the button which has less top surface area than the surface area of the button mid-portion or bottom surface for concentrating the pressure upwardly upon the bottom surface of the pan, especially at the top edge of the tab when it is at an angle when the tab contacts the pan.

Figure 5:
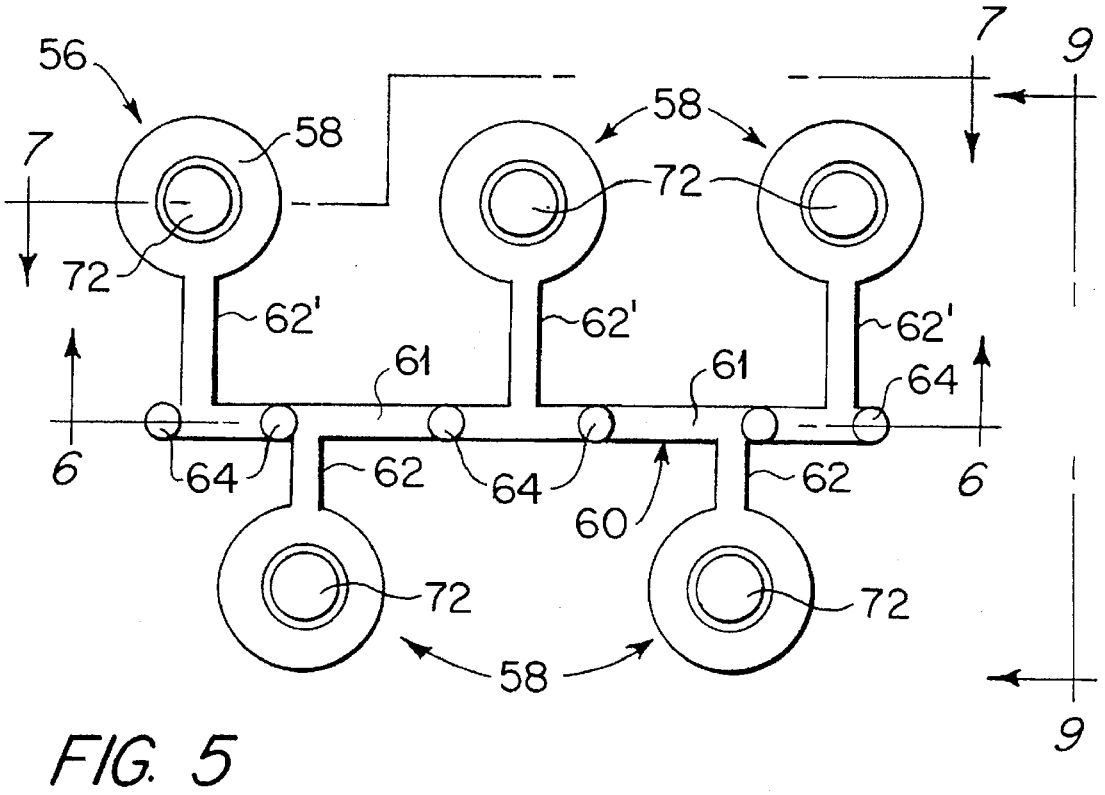
FIG. 5 is a top plan view of the ejector of this invention shown in FIG. 4.
Figure 6:
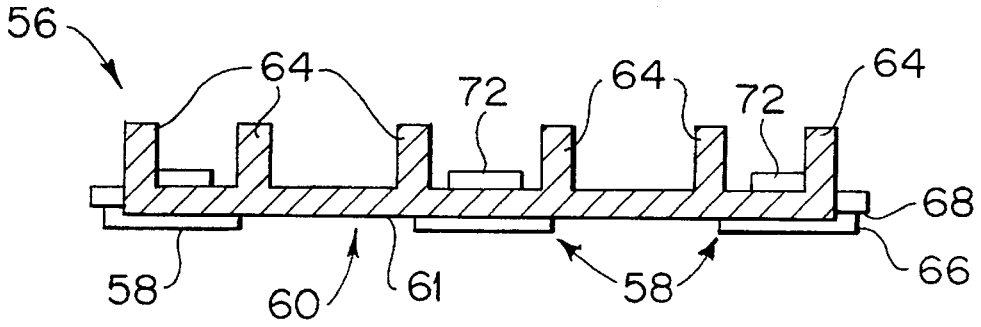
FIG. 6 is a vertical sectional view as would be seen along line 6—6 of FIG. 5.
Figure 7:
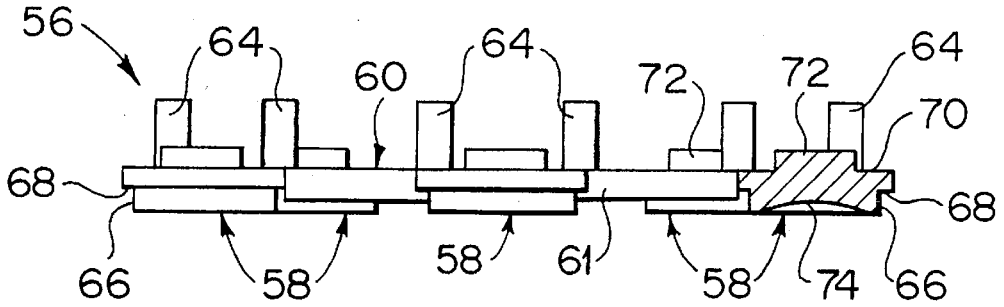
FIG. 7 is a front plan view partially in vertical section as would be seen along line 7—7 of FIG. 5.
Figure 8:
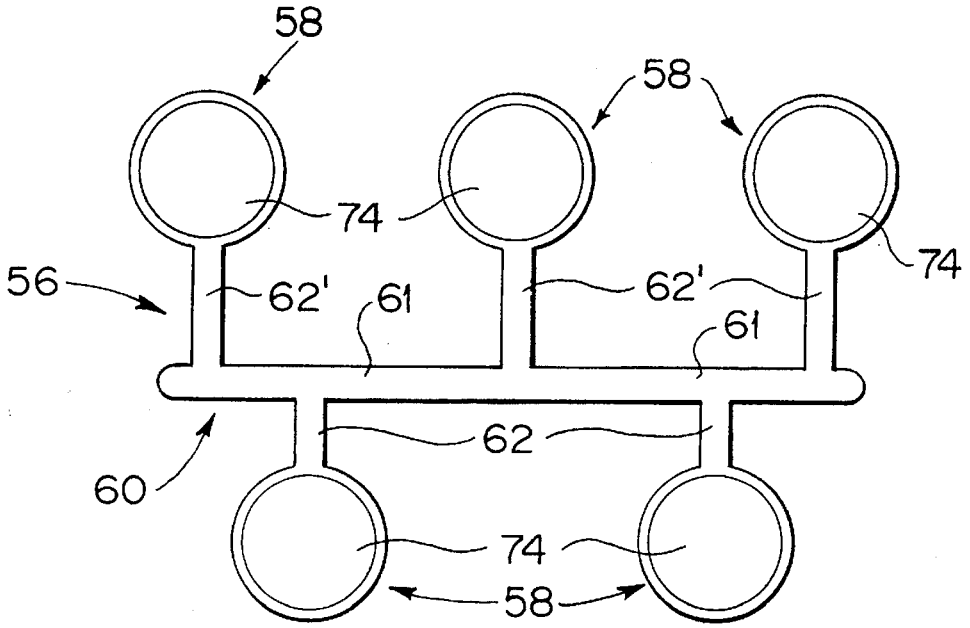
FIG. 8 is a bottom plan view of the ejector shown in FIG. 5.
Figure 9:
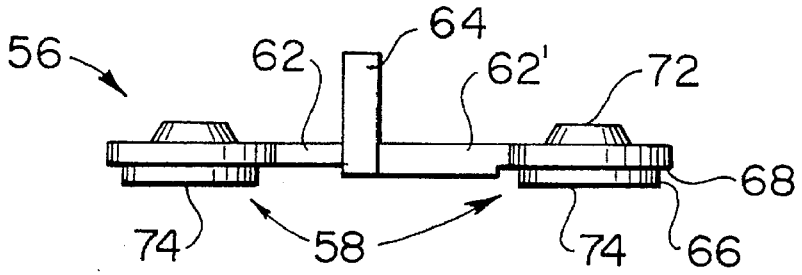
FIG. 9 is an end view as would be seen along line 9—9 of FIG. 5.

The various features of the ejector are easily seen from different viewpoints by referring to FIGS. 4–9 wherein FIG. 5 is a top view, FIG. 6 is a vertical sectional view, FIG. 7 is a front view, FIG. 8 is a bottom view and FIG. 9 is an end view of the ejector of this invention.

More particularly, FIG. 9 shows that the longer arms 62' are vertically thicker than short arms 62 to provide additional rigidity given their longer length such that approximately the same extent of movement of the buttons appended to all arms can be effected with approximately the same pressure. FIG. 9 also shows that at an outer end portion of longer arms 62', the arms are thinned and approximately the same thickness as short arms 62 and as the central portion of the buttons so that in the preferred embodiment stop surface 54 of outwardly extending flange 70 is uniform and in the same plane throughout its extent. The thinned portion also can provide a slight hinging effect.

Referring again to FIGS. 1 through 3 and also more particularly to FIGS. 10 through 12, when assembled within compact 10, ejector 56 is disposed below platform 22 and rests on bottom wall 50 of the compact. Arms 62, 62' extend under sidewall portions 38 and 39 and into apertures 41 of wells 36 of platform 22 such that most of the entirety of each of buttons 58 is located in and below apertures 41. However, tabs 72 extend above bottom walls 40. The top surfaces of button tabs 72 are preferably spaced a small distance below the bottoms of pans 24. Preferably, there is a larger clearance between the bottom edges of shortened sidewall portions 39 and arms 62 and a smaller clearance between sidewall 38 and long arms 62'. This allows the arms to travel or move upward when a button to which an arm is connected is pushed upward through opening 52 in bottom wall 50.

These figures show that the container or compact of this invention, has retaining means, provided by or part of at least two of the container or compact elements, which consist of the structure or platform, the ejector, and the bottom portion, especially the bottom wall, here shown in these figures as platform 22 providing or having first retaining means which include a receptacle in the form of an elongated, inverted U-shaped channel 76. It is formed primarily between depending side wall portions 38 and 39, and second retaining means, here shown as ejector 56 providing or having one or more bosses 64 of ejector 56 which are held or retained by or within the channel. The first and second retaining means thereby cooperate with each other to retain the ejector in an aligned operative position. The retaining means are adapted such that ejector 56 is retained between adhered compact bottom wall 50 and platform 22 and such that each ejector button 58 is seated within its respective bottom wall opening 52, and is aligned with and operative with respect to the opening and an overlying makeup pan 24 (shown in FIG. 3).

Figure 10:
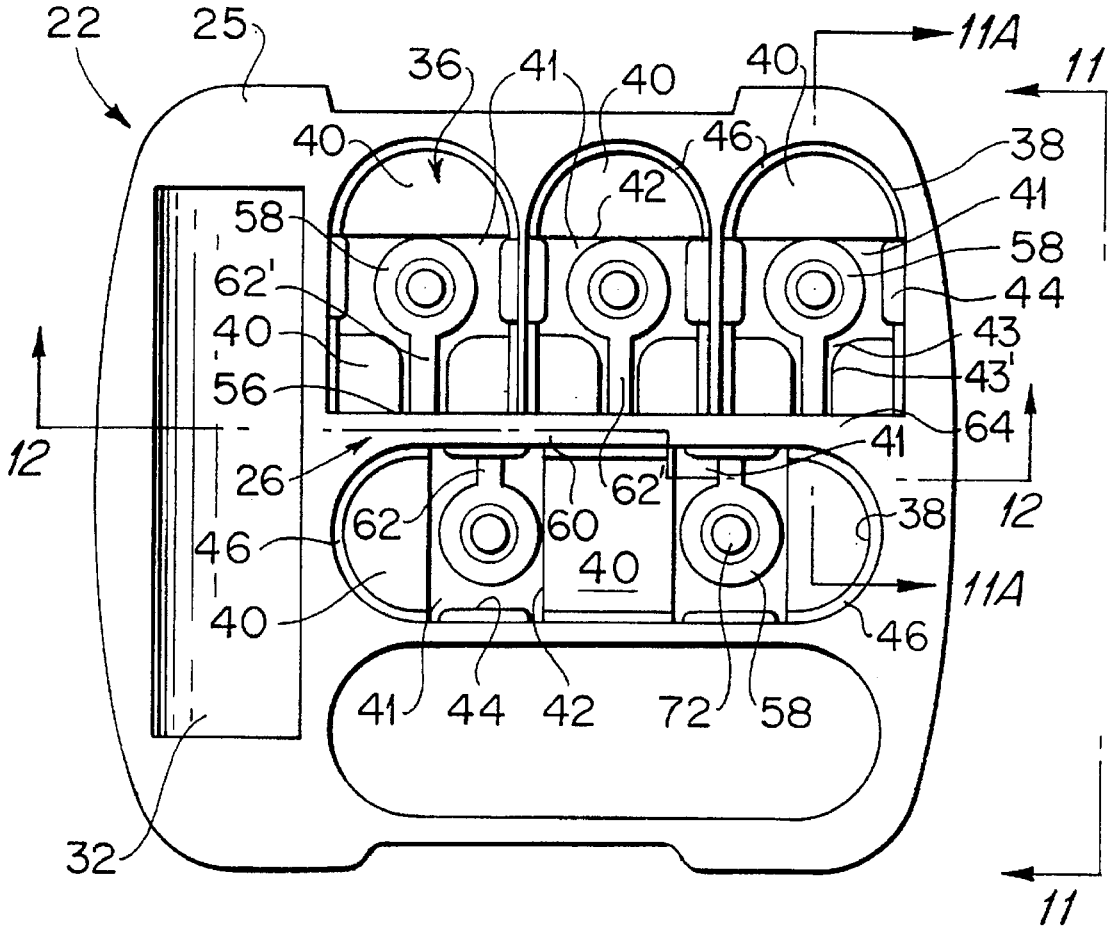
FIG. 10 is a top plan view of the platform and ejector elements of the compact shown in FIG. 1.

FIG. 10 shows platform 22 and shows, in dashed lines, ejector connecting member or runner 60 and bosses 64 aligned with and held or retained beneath central panel ridge 26. FIG. 10 also shows that ejector long arms 62' are retained within the confines of the edges 43' of aperture passageway 43 and buttons 58 are retained within the confines of edges 42 of apertures 41.

Figure 11:
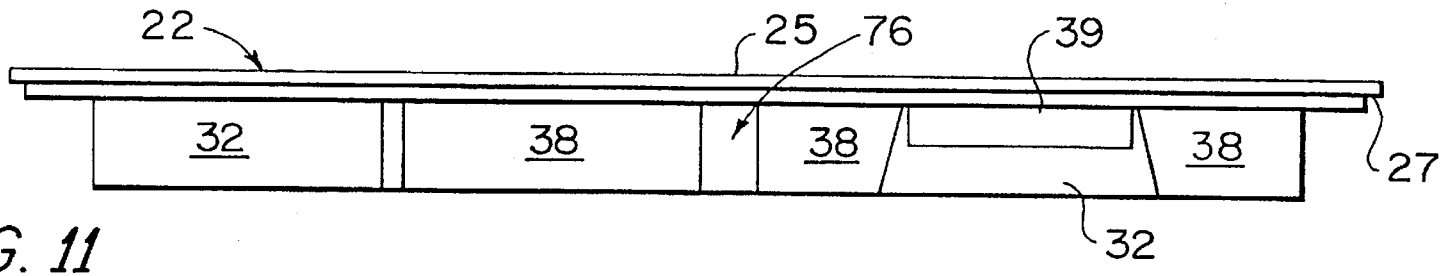
FIG. 11 is a side elevational view as would be seen along line 11—11 of FIG. 10.
Figure 11A:
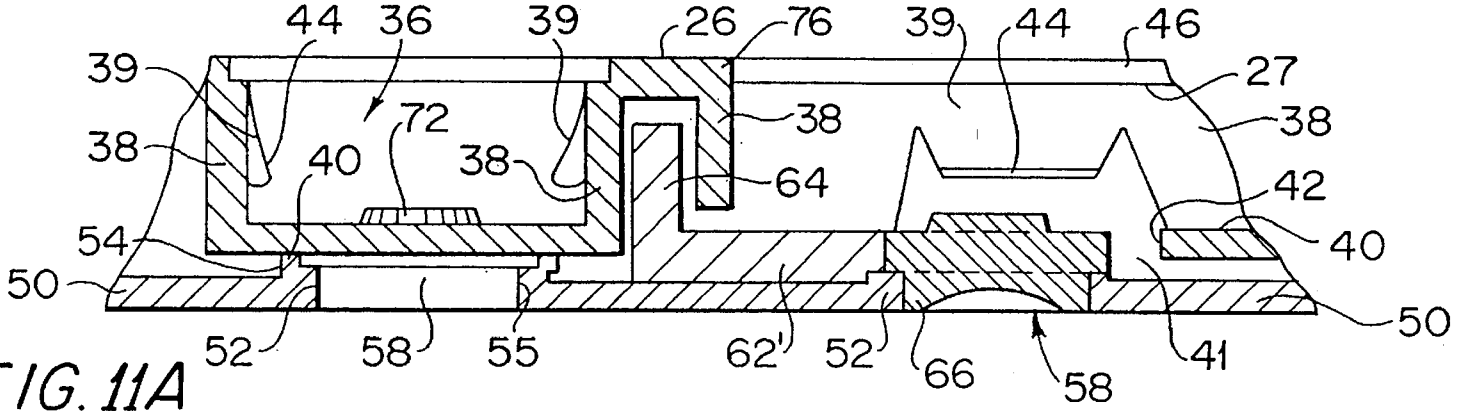
FIG. 11A is an enlarged vertical sectional view with portions broken away and portions in side elevation, as would be seen along a portion of line 11A—11A of FIG. 10.

FIG. 11, a side elevation as would be seen along line 11—11 of FIG. 10, shows a platform receptacle in the form of inverted substantially U-shaped channel 76 formed in this view by side walls 38, but with ejector 56 removed from the channel. FIG. 11A is a vertical section taken along a portion of line 11A—11A of FIG. 10. In FIG. 11A it can be seen that side wall portions 38 and 39 depend from elongated ridge 26 of central panel 25 and form a receptacle. This is also shown as a U-shaped channel 76 which receives and retains at least one, but desirably a plurality of bosses 64 of ejector 56 in the desired aligned position between platform 22 and bottom wall 50.

Figure 12:
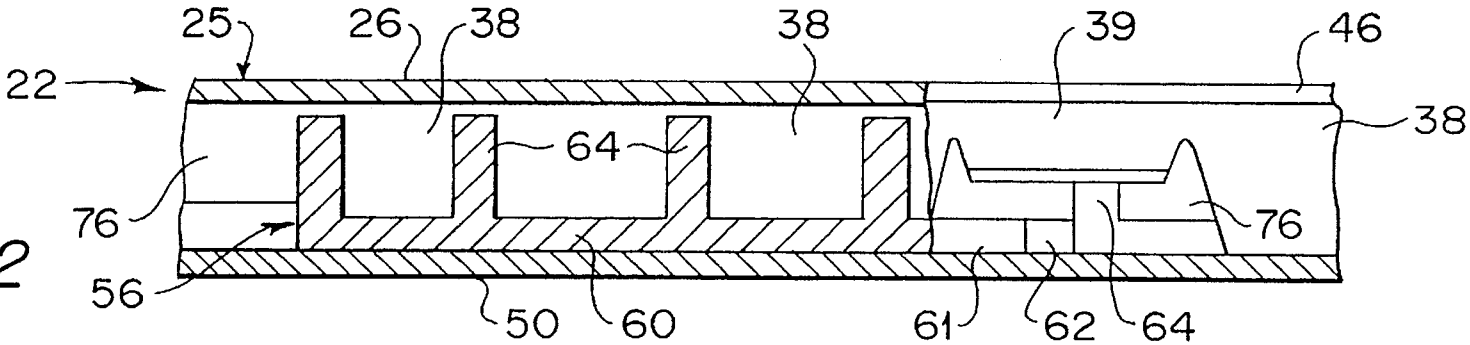
FIG. 12 is an enlarged vertical sectional view with portions broken away, as would be seen along a portion of line 12—12 of FIG. 10.

FIG. 12, a vertical section taken along line 12—12 of FIG. 10 through a portion of inverted U-shaped channel 76, shows ejector bosses 64 aligned with and retained within channel 76 below central panel ridge 26. FIG. 12 shows the U-shaped channel is formed in part by depending side wall portions 38, and in part by short side wall portions 39. FIG. 12 also clearly shows the clearance between the bottom edge of short side wall portion 39 and the top surface of ejector short arm 62, which clearance allows arms 62 to be moved upwardly and also buttons 58 to be moved upwardly into apertures 41 to contact and eject an overlying makeup pan from platform 22.

Figure 13:
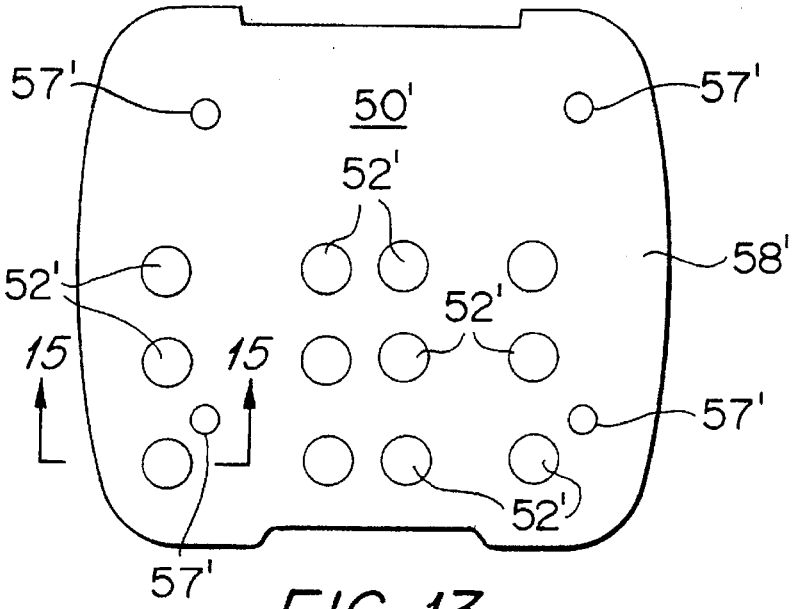
FIG. 13 is a top plan view of the bottom wall of an alternative embodiment of the compact of this invention.
Figure 14:
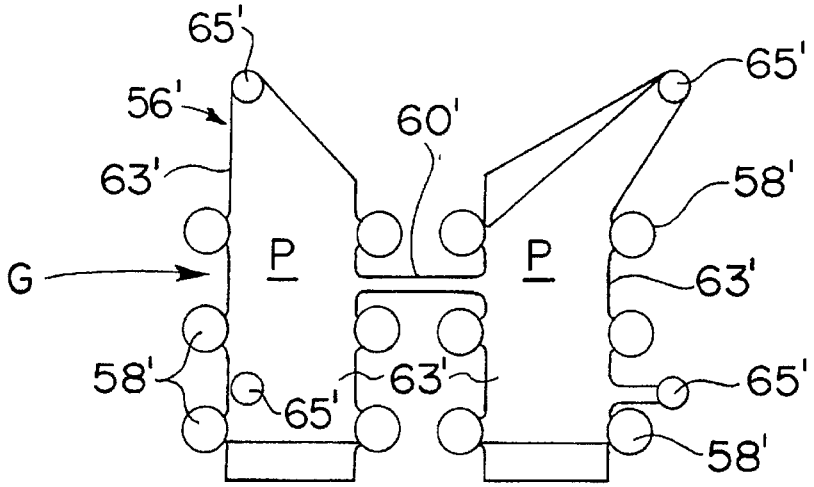
FIG. 14 is a bottom plan view of an alternative embodiment of the ejector of this invention.
Figure 15:
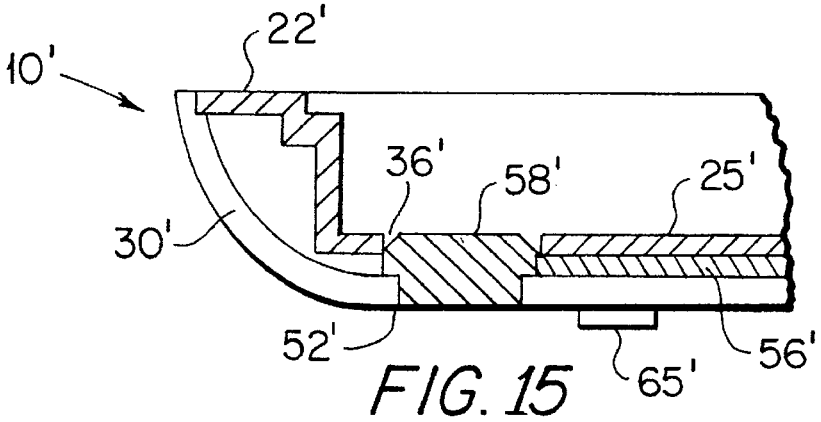
FIG. 15 is a vertical section, with portions broken away, as would be taken through a portion of the bottom of an alternative embodiment of the compact and ejector of this invention.

FIGS. 13, 14 and 15 show an alternative embodiment of the container or compact of this invention. More particularly, FIG. 13 shows a plan view of an alternative bottom wall, generally designated 50', having a plurality of orifices 52' therein, each for receiving a button 58' of an ejector piece 56' (shown in FIGS. 14 and 15), and smaller diameter orifices 57' each for receiving a downwardly depending locator means, boss or foot 65' which depends from ejector 56'.

FIG. 14 is a bottom plan view of an alternative ejector, generally designated 56', here shown as a one-piece gasket G comprised of two juxtaposed panel sections P, joined by a connecting or bridge member 60', each panel section having an outer boundary, here including parallel side edges 63' with a plurality of ejector buttons 58' preferably integrally connected to and extending from the side edges of the panel sections. The plurality of buttons need not be but preferably are arranged in two sets, one set connected to the side edge of one panel section, and the other set connected to the side edges of the other panel section. The panel sections each have locator members which also serve as feet 65', which are appropriately located to depend downwardly through bottom wall orifices 57' for retaining the gasket in its aligned operative position and for supporting the compact on the feet. The buttons are also positioned and spaced from one another off the periphery or outer boundaries of the panel sections such that they communicate with and sit in openings 52' of bottom wall 50'.

As shown in FIG. 15, an enlarged vertical section through a portion of the bottom wall 50', platform 22' is sonically welded, or adhesively or otherwise secured to compact bottom side wall 30'. Platform 22' has a bottom wall 25', which has holes 36' therein which are adapted to allow buttons 58' to travel or be moved upwardly therethrough to directly or indirectly contact an overlying makeup pan (not shown) or structure associated therewith. This allows the pan to thereby be ejected from the platform. Bottom wall 25' is relatively and sufficiently rigid and preferably rests on or is positioned slightly above the gasket. This is especially the case when the gasket is thin and flexible, and serves to maintain the buttons properly seated in their respective bottom wall openings 52'. Although it is not shown, gasket G could of course be comprised of a connecting member in the form of a single panel section having one or more side edges and having buttons connected to the panel section adjacent its side edge(s).

The container or compact of this invention preferably is assembled in the following manner. The bottom portion 18 is disposed face up on a flat surface and ejector 56 is placed in the bottom portion so that buttons 58 sit within bottom wall openings 52. This, of course, aligns the buttons with the openings and the close fit between the bottom wall opening side edges 55 and the button side walls 66 retains the buttons aligned and operative in the openings by substantially preventing lateral movement of the ejector relative to the bottom portion. Platform 22 is then placed on and secured to the bottom portion 18 such that they will remain secured to each other by an adherent force greater than the pan ejection force. Preferably, the platform undersurface 27 and bottom side wall upper surface are respectively and complementarily stepped (when viewed in vertical section) and their abutting surfaces are secured by any suitable means, preferably by sonic welding. Less preferably, the surfaces can be secured by a band or series of spots of an appropriate adhesive.

In securing platform 22 to compact bottom portion 18, the secured platform is disposed such that inverted U-shaped channel 76 fits over and retains ejector upstanding bosses 64. Likewise, this also provides that edges 43' of passageways 43 encompass the ejector long arms 62'. Platform side walls 38 and 39 of channel 76 retain ejector 56 by helping to prevent the ejector from being displaced laterally in the forward or rearward direction. Edges 43 of passageways 43 and edges 42 of apertures 41 of well bottom walls 40 retain ejector 56 by helping prevent the ejector from being displaced laterally from side-to-side or along the channel. Buttons 58, which are and function as locator members, within bottom wall openings, which are and function as receptacles, cooperate to help prevent lateral movement of the ejector relative to the compact. The securement of the platform 22 to the bottom portion 18 retains the ejector by preventing vertical displacement of the ejector. The above combination of retaining means of this invention cooperate to retain the ejector in its aligned, operative position, although less than the above described preferred combination of retaining means can effectively be employed.

The ejector of this invention has one or more flexible portions and can be made of any suitable material which is rigid enough for the locator members to be received and maintained in an aligned position. At the same time, it must be flexible enough to allow the respective buttons to be moved a sufficient distance, to contact the buttons or a structure associated therewith to thereby eject the pans from their holding means, and, when the moving pressure is released, to return on their own to their normal position. In the normal position, each is seated within its respective bottom wall opening and preferably such that its respective bottom surface is aligned with the plane of the bottom surface of the compact's bottom wall. The ejector connecting member(s) and/or its arms, gasket, panel section(s) and/or button hinges preferably act as a leaf spring in providing the buttons with the aforementioned ejection movement and return capability. Examples of suitable materials for forming the ejector are synthetic materials such as plastics, e.g. polyolefins and polyesters. The preferred material is a polypropylene homopolymer or copolymer, although like materials, also providing sufficient rigidity and flexibility to the ejector (such as polyethylenes of various densities), can also be used. Suitable elastomeric materials can be employed or added to other resins to provide any desired flexibility.

The ejector and its connecting members and buttons can be of any shape, thickness, design or configuration suitable for performing the functions intended. Preferably, as shown, the ejector, connecting member, arms and buttons are in a substantially horizontal plane. The ejector can be made by any appropriate method, but preferably the ejector is made by injection molding, as its preferred configuration, e.g. with integral upwardly extending locator means, lends itself to being easily and economically injection molded. Of course, other suitable forming or molding processes, for example, those which employ heat and/or pressure can be employed.

The buttons can be of any suitable number, size, shape and configuration, and they can be appended to or associated with the ejector or connecting member by any appropriate means. The buttons preferably are, but need not be integrally formed with a connecting member or gasket. The preferred buttons have the aforedescribed stop surface to prevent them from protruding below the bottom surface of compact bottom wall.

The means for retaining the ejector in aligned operative position within the compact can be or include any appropriate means, which can be part of the compact, its platform or one or more other structures. The retaining means can include for example, one or more female means such as receptacles, indents, holes, channels, grooves, loops, or other means cooperative with other retaining means, such as male means, such as locator members, bosses or like male elements, to thereby retain the ejector and buttons in the desired aligned operative positions. It is understood that these cooperative means can be arranged in any appropriate manner, combinations and/or locations. As merely one non-limiting example, the location of these means can be reversed from what has been shown and described, such that some or all of the first retaining means can be positioned on the ejector and some or all of the second retaining means can be located on the structure or platform or bottom wall or bottom portion.

INDUSTRIAL APPLICABILITY

The present invention is particularly suitable for application to modern industrial processes. In particular, the ejector easily and rapidly can be injection molded in large quantities while forming minimal scrap or waste. Orientation and assembly of the ejector with the compact components can be automated or otherwise easily, quickly and economically effected. Once assembled, the ejector will retain its aligned operative disposition and the ejector material(s) will retain their movement and return capability during the useful life of the compact.

While illustrative embodiments of the invention have been described above, it is, of course, understood that various modifications will be apparent to those of ordinary skill in the art. Such modifications are within the spirit and scope of the invention, defined by the appended claims.

What is claimed is:

1. A container comprising:

a) a top portion, b) a bottom portion, the top portion being movably connected to the bottom portion to open and close the same, the bottom portion having a bottom wall with openings therein, and means for holding a structure, c) a structure adapted to be held by the holding means and having means for removably holding each of a plurality of articles in the structure, each bottom wall opening being positioned such that a portion of each respective article when held by its holding means, is associated with an opening in the bottom wall, and d) an article ejector disposed between the bottom wall and structure, and comprised of:

i) a plurality of ejector buttons, and ii) a connecting member which connects the buttons to each other, and e) means for retaining the ejector in aligned operative position between the structure and the bottom wall, the retaining means including cooperative first and second retaining means provided by at least two of the container elements selected from the structure, the article ejector and the bottom wall the retaining means being adapted such that each respective button is aligned with a respective bottom wall opening and an associated article when the articles are held by their holding means, and operative such that when pressure is applied upwardly through a bottom wall opening onto a button, the button moves and applies upward pressure to an overlying article and ejects it from its holding means, the retaining means including cooperative first and second retaining means.

2. The container of claim 1, wherein the structure includes the first retaining means comprised of one or more receptacles and the ejector includes the second retaining means comprised of one or more locator members which extend from the ejector, and are retained by the one or more receptacles.

3. The container of claim 2, wherein the structure comprises a platform, and the one or more locator members comprise one or more bosses which extend upwardly from the connecting means.

4. The container of claim 3, wherein the one or more receptacles include an inverted U-shaped channel defined by walls which depend from the platform.

5. The container of claim 4, wherein the channel retains a portion of the connecting member.

6. The container of claim 4, wherein the connecting member has a main body and one or more arms, each of which extends from the main body and communicates with a button and the one or more receptacles include one or more passageways each of which retains an arm.

7. The container of claim 1, wherein the bottom wall includes the first retaining means comprised of one or more receptacles and the ejector includes the second retaining means comprised of one or more locator members which extend from the ejector and are retained by the one or more receptacles.

8. The container of claim 3, wherein each bottom wall opening is defined by a rim, and each button has a depending sidewall which is disposed within the opening with respect to which the button is aligned.

9. The container of claim 8, wherein each button has a stop surface which is adjacent and extends beyond its side wall, the stop surface being adapted to abut the bottom wall rim and prevent the button from protruding through the opening.

10. The container of claim 9, wherein each button has an upwardly extending tab thereon, and the ejector is adapted to allow the tab to contact and eject an overlying respective article from the structure.

11. The container of claim 1, wherein a portion of the connecting member is flexible.

12. The container of claim 6, wherein the one or more arms each have one or more flexible portions.

13. A compact comprising:

(a) a top portion, (b) a bottom portion, the top portion being movably connected to the bottom portion to open and close the same, the bottom portion having a bottom wall with openings therein and means for holding a platform, (c) a platform adapted to be held by the holding means and having means for removably holding each of a plurality of pans in the platform, each bottom wall opening being defined by a rim and being positioned such that a portion of each respective pan, when held by its holding means, overlies an opening in the bottom wall, (d) a pan ejector disposed between the bottom wall and platform, having one or more flexible portions and comprised of i) a plurality of ejector buttons each having a bottom surface, and ii) a connecting member which connects the buttons to each other, iii) one or more bosses which extend upwardly from the connecting member, the platform having one or more receptacles which receive one or more of the bosses and maintain each respective button in alignment with a respective overlying pan and bottom wall opening, each button having a side wall depending therefrom disposed within the rim of the opening with which it is aligned, and having a stop surface adapted to engage the bottom wall rim to prevent the button from extending beyond the lower surface of the bottom wall, the compact and ejector being adapted and the ejector being so disposed that when pressure is applied upwardly through a bottom wall opening onto the button bottom wall surface, the button applies pressure to and ejects an overlying pan from its holding means.

14. The compact of claim 13, wherein the one or more receptacles include an inverted U-shaped channel defined by walls which depend from the platform.

15. The compact of claim 14, wherein the channel retains a portion of the connecting member.

16. The compact of claim 14, wherein the connecting member has a main body and one or more arms, each of which extends from the main body and communicates with a button and the one or more receptacles includes one or more passageways each of which retains an arm.

17. The container of claim 13, wherein each button has an upwardly extending tab thereon, and the ejector is adapted to allow the tab to contact and eject an overlying respective article from the structure.

18. The container of claim 13, wherein a portion of the connecting member is flexible.

19. The container of claim 16, wherein the one or more arms each have one or more flexible portions.

20. The compact of claim 13, wherein the compact is adapted to allow a selected one or more of the buttons to move from a normal position upon the application of pressure thereto in order to contact and eject the respective overlying pan or pans, and, upon the release of the pressure, to return the selected one or more buttons to the normal position.

21. An article ejector in combination with a container for ejecting one or more removable articles from the container having a bottom wall with a configuration of openings therein, the ejector comprising:

(a) a plurality of ejector buttons having a bottom surface and a top surface, (b) a connecting member for connecting the buttons to each other and oriented relative to each other in a button configuration corresponding to the configuration of openings in the bottom wall of the container, and (c) locator means for retaining the position of the ejector in an operative position when positioned in the container, such that the button configuration is aligned to the configuration of the openings in the bottom wall of the container, whereby, when the ejector is oriented within the container and upward pressure is applied to the bottom surface of one or more of the buttons, the pressure will move the button from a normal position to eject an article from the container, and upon removal of said upward pressure, the button will return to a normal position.

22. The ejector of claims 21, wherein the connecting member extends mostly in a horizontal plane and the locator means include locator members which extend upwardly from the connecting member.

23. The ejector of claim 22, wherein each button has a lower side wall and a stop surface extending outwardly from the button above and beyond the side wall.

24. The ejector of claim 23, wherein each button has a top surface having less surface area than the bottom surface.

25. The ejector of claim 21, wherein the connecting member includes an elongated main body which communicates with the locator members, and a plurality of arms each of which has a flexible portion, extends from the main body and communicates with a button.

26. The ejector of claim 25, wherein the locator members are bosses.

27. The ejector of claim 21, wherein the connecting member extends mostly in a horizontal plane and the locator members extend downwardly from the connecting member.

28. The ejector of claim 21, wherein the connecting member includes a flexible gasket.

29. The ejector of claim 28, wherein the gasket includes a panel section having a side edge, and the buttons are connected to the gasket adjacent the side edge.

30. The ejector of claim 28, wherein the gasket includes two juxtaposed panel sections connected to each other by a bridge member, each panel section having a side edge and the buttons being arranged in two sets, with one set connected to and extending outwardly from the side edge of one panel section, and the other set extending outwardly from the side edge of the other panel section.

* * * * *